United States Patent [19]

Matsui et al.

[11] Patent Number: 4,841,582

[45] Date of Patent: Jun. 27, 1989

[54] WASHER CONSTRUCTION FOR A SANITARY DEVICE

[75] Inventors: Hideo Matsui, Toyota; Yuji Yamaguchi, Anjo; Hideki Furukawa, Kariya, all of Japan

[73] Assignee: Aisin Seiki Kabushiki Kaisha, Aichi, Japan

[21] Appl. No.: 175,382

[22] Filed: Mar. 30, 1988

[30] Foreign Application Priority Data

Mar. 30, 1987 [JP] Japan ..... 62-76945

[51] Int. Cl.[4] ..... A61H 35/00; A47K 7/08

[52] U.S. Cl. ..... 4/420.1; 4/420.3; 4/445; 4/448

[58] Field of Search ..... 4/420.1, 420.2, 420.3, 4/420.4, 420.5, 443, 444, 445, 446, 447, 448

[56] References Cited

U.S. PATENT DOCUMENTS 4,208,746 6/1980 Minamoto et al. ..... 4/420.2

4,208,746 6/1980 Minamoto et al. ..... 4/420.2

OTHER PUBLICATIONS

Drawing from Japanese Laid Open Application 5,826,142.

*Primary Examiner*—Renee S. Luebke

*Assistant Examiner*—Robert Fetsuga

*Attorney, Agent, or Firm*—Sughrue, Mion, Zinn, Macpeak & Seas

[57] ABSTRACT

A washer construction for a sanitary device adapted to be associated with a toilet bowl includes a hot water tank having a pair of extendable and retractable nozzles extending through the wall of the tank into the interior of the toilet bowl for washing purposes. A pair of solenoid operated valves control the flow of hot water to the respective nozzles whereby upon energization of the solenoid operated valves, the hot water under pressure will extend the nozzles and be sprayed outwardly through apertures in the ends of the nozzles. Upon de-energization of the respective solenoid operated valve, a spring will retract the plunger and force the remaining hot water in the nozzle through a conduit and eject the water from the conduit on to the surface of the nozzle as it is being retracted for cleaning purpose.

3 Claims, 2 Drawing Sheets

WASHER CONSTRUCTION FOR A SANITARY DEVICE

BACKGROUND OF THE INVENTION

The present invention relates to a washer construction for a sanitary device, and in particular to a washer construction including a nozzle means which is operated by water under pressure.

As shown in FIG. 1, a conventional sanitary device, which is disclosed in Japanese Patent Laid Open Application No. 58-26142, includes a tank 60 filled with hot water which is warmed by a heater (not shown) up to a predetermined temperature. When cold water under pressure is supplied to an inlet port 60 of the tank 60, hot water is forced out through a nozzle means 62. The interior portion of the tank 60 is closed by a valve body 69 of a vacuum breaker 70 and a plunger 63 is extended to a position (shown in phantom lines) in the interior portion of a toilet bowl (not shown) against the force of a spring 64. As soon as the plunger 63 reaches the extended position, a one-way valve 65 is opened by hot water under pressure enabling hot water to be ejected from plural apertures 66 to the portion of a user's body to be washed. Hot water under pressure is also supplied to an inlet port 67*a* of a pipe 67 through a passage 68. An outlet port 67*b* of the pipe 67 is directed toward the extending or retracting plunger 63 for washing the plunger. Upon shutting off the water supply to the inlet port 61, the plunger 63 is returned to its original position due to expansion of the spring 64. Due to retracting movement of the plunger 63, an amount of hot water is forced out of the tank 61 and is drained to the interior portion of the toilet bowl through the pipe 67.

Since the majority of the hot water in the tank 60 has to be supplied to the nozzle means 62 for fulfilling the washing of the user's body, the quantity of hot water to be supplied to the pipe has to be minimized as much as possible. This means that retracting speed of the plunger 63 is too slow.

SUMMARY OF THE INVENTION

It is, therefore, an object of the present invention to provide a washer construction for a sanitary device in which a plunger may be retracted to its original position. To this end, the present invention provides a water circuit in a sanitary device comprising:

(1) a tank filled with hot water warmed up to a predetermined temperature and having a supply port to which water under pressure is supplied;

(2) an electrically operated valve having:

(a) an inlet port exposed to said hot water in said tank, (b) a first outlet port, (c) a second outlet port, (d) a solenoid, and (e) a valve member by which said two outlet ports are connected with each other upon deactuation of said solenoid and by which said inlet port is connected to said second outlet port upon actuation of said solenoid;

(3) a nozzle means including:

(a) a casing formed at one end portion and the other end portion thereof, respectively, with a first opening and a second opening, said first opening being connected to said second outlet port of said electrically operated valve, (b) a plunger slidably fitted in said casing, (c) a blind bore formed in said plunger and having openings at one end portion thereof, said openings being oriented to said second outlet port of said electrically operated valve, (d) aperture means formed at the other end portion of said plunger, (e) a spring disposed in said casing and urging said plunger so that said opening thereof may be disposed adjacent to said first opening of said casing, and (f) a one-way valve disposed in said opening of said blind bore so as to be opened, when said plunger is extended to a position in an interior portion in a toilet bowl, by said water supplied to said first opening of said casing; and (4) a conduit having at opposite end portions thereof, respectively, an inlet opening and an outlet opening, said inlet opening being connected to said first outlet port of said electrically operated valve and said outlet opening being exposed to said interior portion of said toilet bowl.

Therefore, during retraction of the plunger under the condition that the solenoid is deactuated, the inlet port is closed and the second and the third outlet ports are connected with each other with the result that the remaining hot water between the nozzle means and the electrically operated valve is forced out by the retracting plunger through the conduit into the interior portion of the toilet bowl. By enlarging the radius of the second outlet port or the conduit, the retracting speed may be faster than that of the conventional sanitary device described above. As a result of such construction, the second outlet port is closed during hot water supply to the nozzle means and a desired amount of hot water for washing a user's body is ensured.

The above and other objects, features and advantages of the present invention will become more apparent from the following description of a preferred embodiment taken in conjunction with the accompanying drawing.

DESCRIPTION OF THE PREFERRED EMBODIMENT

Figure 1:
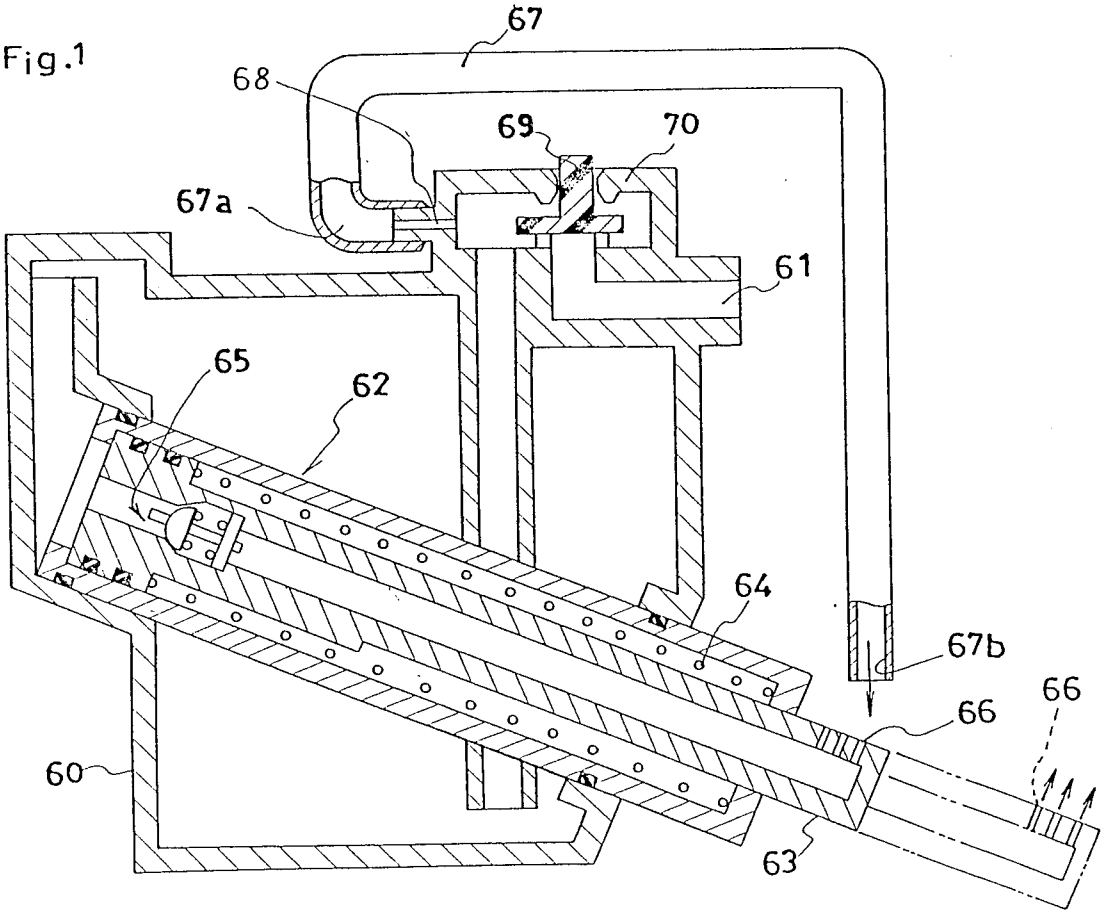
FIG. 1 is a cross-sectional view of a conventional sanitary device.
Figure 2:
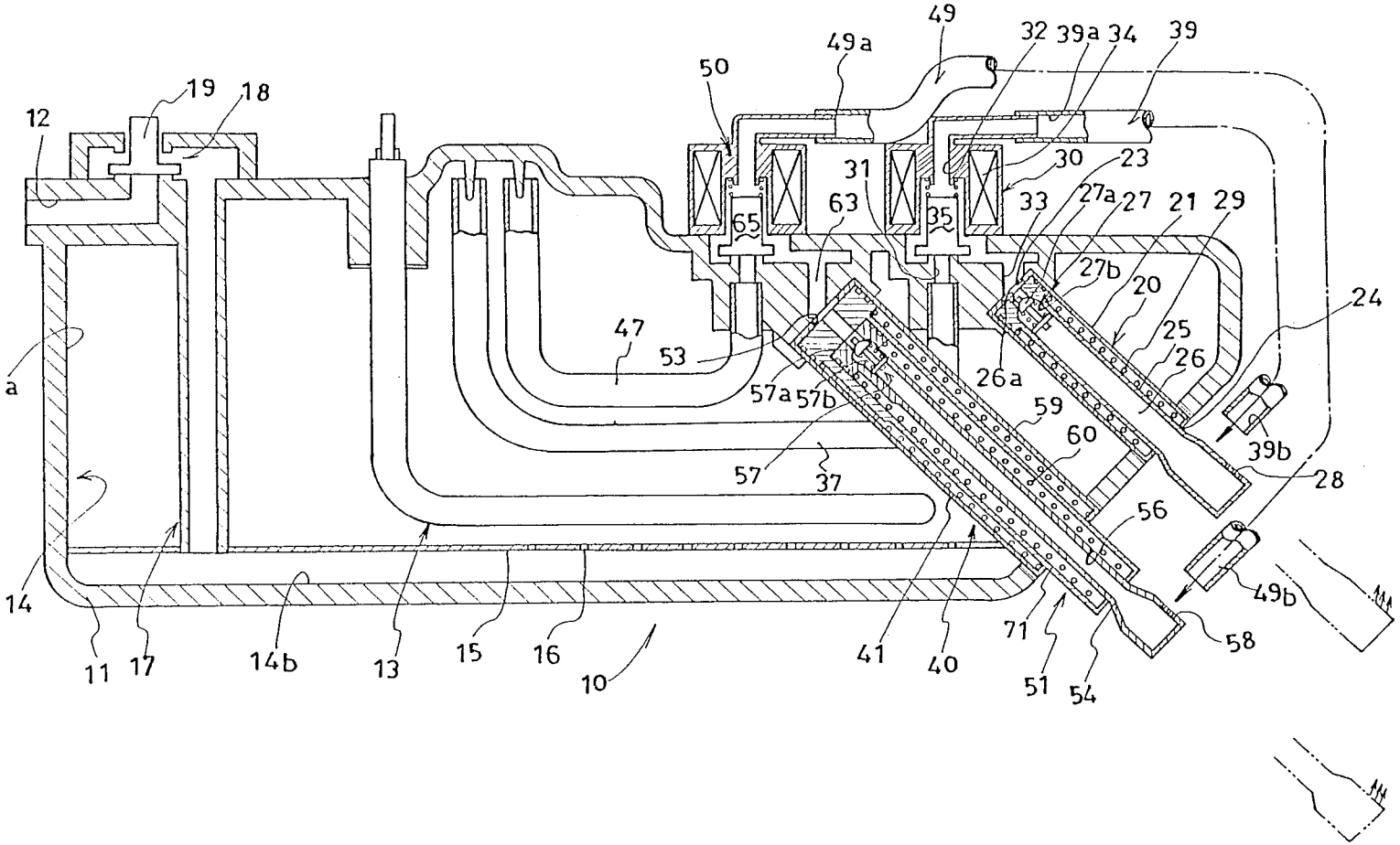
FIG. 2 is a cross-sectional view of a sanitary device to which the present invention is applied.

One embodiment of the present invention will be described in detail with reference to FIG. 2.

A tank 10 includes a main body 11 having an inlet port 12 to which cold water under pressure is supplied. The main body 11 is filled with hot water which is warmed up to a predetermined temperature by a heater 13. The interior portion 14 of the main body 11 is divided into an upper portion 14*a* and a lower portion 14*b* by a base plate 15 provided with a plurality of apertures 16. The lower portion 14*b* of the interior portion 14 is connected to the inlet port 12 by a vertically extending pipe 17 and a vacuum breaker 18 having a valve member 19. The valve member 19 interrupts fluid communication between the inlet port 12 and the pipe 17 when no cold water under pressure is supplied to the inlet port 12.

A first nozzle means 20 for washing the anal area is fixedly mounted to the main body 11 of the tank 10. The first nozzle means 20 includes a casing 21 having at one end portion and the other end portion thereof, respectively, a first opening 23 and a second opening 24. In the casing 21, there is slidably fitted a plunger 25 having therein a blind bore 26 having an opening 26*a* aligned with the first opening 23 of the casing 21. A one-way valve 27 is disposed in the opening 26*a* of the blind bore 26 and includes a body 27*a* and a spring 27*b* for closing the opening 26*a*. The plunger 26 is formed at the distal end portion thereof with plural apertures 28. The plunger 26 is continually urged toward the first opening 23 of the casing 21 by a spring 29.

A first electrically operated valve 30 is positioned near the first nozzle means 20 and is in the form of a 3-way valve having an inlet port 31, a first outlet port 32, a second outlet port 33, solenoid 34 and a valve member 35. The valve 30 operates in such a manner that the member 35 closes the inlet port 31 for allowing fluid communication between the first and second outlet ports 32, 33 during de-energization of the solenoid 34 and the member 35 closes the first outlet port 32 for allowing fluid communication between the inlet port 31 and the second outlet port 33 during energization of the solenoid 34. The inlet port 31 is in fluid communication to the upper portion 14*a* of the main body 11 of the tank 10 via a first pipe 37. The first outlet port 32 is connected to an inlet opening 39*a* of a first conduit 39 whose outlet opening 39*b* is directed toward the apertures 28 of the plunger 25 in the interior portion of the toilet bowl.

A second nozzle means 40 for washing the vaginal area is provided in the main body 11 of the tank 10. The second nozzle means 40 is similar to the first nozzle means 20 in construction except that a plunger 45 of the nozzle means 40 extends into the interior portion of the toilet bowl in a 2-stage extension operation. That is to say, when water under pressure is supplied to an opening 53 of a casing 41, a piston 69 which is formed integrally with a casing 71 is pushed out against a spring 59. When the casing 71 is stopped at an extended position, the plunger 45 is extended further outwardly. When the plunger 45 is fully extended, a valve member 57*a* of the valve 57 is opened against a spring 57*b* and hot water under pressure passes through a bore 56 in the plunger 45. The hot water is ejected to the vaginal portion of the user through apertures 58 in the end of the plunger 45. A second electrically operated valve 50, a second conduit 49 and a second pipe 47 are respectively similar to the first electrically operated valve 30, the first conduit 39 and the first pipe 37 in construction and function.

In operation, when cold water under pressure is supplied to the inlet port 12 after energization of the solenoid 34 due to previous selection of anus-washing, the valve member 19 is urged in the upward direction due to water pressure, thereby opening the lower portion 14*b* of the main body 11 of the tank 10. Thereafter, hot water is forced into the first nozzle means 20 via the first pipe 37, the inlet port 31 of the first valve 30 and the second outlet port 33 which is in fluid communication to the inlet port 31 due to upward displacement of the valve member 35 by the solenoid 34. Then, the plunger 25 is extended against the spring 29 into the position which is shown in phantom lines in the interior portion of the toilet bowl. As soon as the plunger 25 reaches the extended position, the one-way valve 27 is opened, whereby hot water flows into the bore 26 and ejected from the apertures 28 toward the anus.

Due to de-energization of the solenoid 34 after anus washing, the valve member 35 is returned to its original position, whereby the inlet port 31 is closed and the first outlet port 32 is brought into fluid communication with the second outlet port 33. Since water supply into the inlet port 31 ceases after completion of anus washing, no pressure is supplied to the first nozzle means 20. Thus, the plunger 25 is returned to its original position by expansion of the spring 29. During retracting movement of the plunger 25, remaining hot water between the first valve 30 and the plunger 25 is supplied to the first outlet port 32 so that the remaining hot water flows through the first conduit 39 and is discharged in the interior of the toilet bowl against the plunger 25 to wash the plunger as it is being retracted.

In a similar manner, when it is desired to wash the vaginal area of a person sitting on a toilet, the solenoid operated valve 50 is energized to move the valve member 65 upwardly thereby placing the second nozzle means 40 in communication with the upper portion 14*a* of the tank 10 through the pipe 47 and the passage 63. Thus, cold water under pressure is supplied to the inlet port 12 and the valve member 19 is urged in the upward direction in response to the water pressure, thereby opening the lower portion 14*b* of the tank 10. The hot water is then forced into the second nozzle means 40 via the second pipe 47, the passage 63 and the opening 53 in the casing 41. The piston 69 is moved outwardly of the casing 41 against the force of the spring 59 until it reaches its limit and then the plunger 45 is extended further into the interior of the toilet bowl against the force of the spring 60 until it reaches its limit. Thereafter, the valve member 57*a* is opened against the force of the spring 57*b* due to the water pressure and the hot water is ejected through the passage 56 and the apertures 58 in the end of the plunger 45.

Upon de-energization of the solenoid valve 50, the valve member 65 closes the passage between the pipe 47 and the passage 63 and places the passage 63 in communication with the conduit 49 which is secured at one end 49*a* to the solenoid operated valve 50. The other end 49*b* of the conduit 49 is directed toward the plunger 45. As the valve member 57*a* is closed due to the force of the spring 57 and the piston 69 and plunger 45 are retracted by their respective springs 59 and 60, the water remaining in the nozzle means 40 and the passage 63 will be forced through the conduit 49 and ejected against the plunger 45 as it is being retracted to wash the plunger.

Thus, the conduits 39 and 49 connected between the nozzle means 20 and 40, respectively, by means of the solenoid operated valve assemblies 30 and 50, respectively, provide an improved water flow circuit for washing the nozzles as they are being retracted subsequent to a washing operation.

While the invention has been particularly shown and described with reference to preferred embodiments thereof, it will be understood by those in the art that the foregoing and other changes in form and details may be made therein without departing from the spirit and scope of the invention.

What is claimed is:

1. A washer construction for a sanitary device for use with a toilet bowl comprising:

tank means adapted to be filled with hot water warmed to a predetermined temperature and having a supply port to which cold water under pressure is supplied;

electrically operated valve means mounted on said tank and having an inlet port exposed to said hot water in said tank means, a first outlet port, a second outlet port, a solenoid, and a valve member movable between a first position wherein said two outlet ports are connected with each other and disconnected from said inlet port upon de-energization of said solenoid and a second position wherein said inlet port is connected to said second outlet port and disconnected from said first outlet port upon energization of said solenoid;

nozzle means extending outwardly from said tank means and including a casing formed at one end portion thereof and at the other end portion thereof, a first opening and a second opening, respectively, said first opening being connected to said second outlet port of said electrically operated valve means, a plunger slidably fitted in said casing and extending through said second opening, a bore formed in said plunger and having an opening at one end portion thereof in communication with said first opening of said casing and said second outlet port of said electrically operated valve means, aperture means formed at the other end portion of said plunger, a spring disposed in said casing and urging said plunger so that said opening thereof may be adjacent to said first opening of said casing, and a one-way valve means disposed in said opening of said bore adapted to be opened when said plunger is extended from said casing to a position in an interior portion of a toilet bowl by water under pressure supplied to said first opening of said casing; and a conduit having at opposite end portions an inlet opening and outlet opening, respectively, said inlet opening being connected to said first outlet port of said electrically operated valve and said outlet opening is exposed to said interior portion of said toilet bowl.

2. A washer construction for a sanitary device in accordance with claim 1, wherein said outlet opening of said conduit is directed toward said plunger adjacent said second opening of said casing to wash said nozzle upon retraction into said casing.

3. A washer construction for a sanitary device in accordance with claim 1 further comprising an additional electrically operated valve means, additional nozzle means and an additional conduit substantially identical to said first mentioned valve means, nozzle means and conduit in construction and operation with said additional nozzle means disposed parallel to said first mentioned nozzle means.

* * * * *